US006201190B1

(12) United States Patent
Pope

(10) Patent No.: US 6,201,190 B1
(45) Date of Patent: Mar. 13, 2001

(54) DOUBLE FOIL TAPE COAXIAL CABLE

(75) Inventor: Bradley Gene Pope, Richmond, IN (US)

(73) Assignee: Belden Wire & Cable Company, Richmond, IN (US)

( * ) Notice: Subject to any disclaimer, the term of this patent is extended or adjusted under 35 U.S.C. 154(b) by 0 days.

(21) Appl. No.: 09/153,532

(22) Filed: Sep. 15, 1998

(51) Int. Cl.[7] ..... H01B 7/18
(52) U.S. Cl. ..... 174/102 R; 174/106 R
(58) Field of Search ..... 174/102 R, 103, 174/106 R, 28

(56) References Cited

U.S. PATENT DOCUMENTS

| | | | | |
|---|---|---|---|---|
| 410,953 | | 9/1889 | Brooks, Jr. . | |
| 1,705,949 | | 3/1929 | Williams . | |
| 1,722,153 | | 7/1929 | Meurer et al. . | |
| 1,935,323 | | 11/1933 | Kemp et al. | 173/266 |
| 2,594,983 | * | 4/1952 | Pease | 174/44 |
| 3,340,353 | * | 9/1967 | Mildner | 174/106 |
| 3,636,234 | * | 1/1972 | Wakefield | 174/36 |
| 3,927,247 | | 12/1975 | Timmons | 174/36 |
| 4,328,394 | | 5/1982 | Aloisio, Jr. et al. | 174/106 D |
| 4,449,013 | | 5/1984 | Garschick | 174/103 |
| 4,751,614 | | 6/1988 | Mehnert | 361/437 |
| 4,847,448 | | 7/1989 | Sato | 174/103 |
| 4,974,926 | * | 12/1990 | Blee et al. | 350/96.23 |
| 5,068,497 | | 11/1991 | Krieger | 174/106 R |
| 5,270,486 | * | 12/1993 | Chan et al. | 174/23 |
| 5,321,202 | | 6/1994 | Hillburn | 174/36 |
| 5,374,778 | * | 12/1994 | Hashimoto et al. | 174/36 |
| 5,414,213 | | 5/1995 | Hillburn | 174/36 |
| 5,434,354 | | 7/1995 | Baker et al. | 174/36 |
| 5,521,331 | | 5/1996 | Hillburn | 174/36 |
| 5,574,260 | * | 11/1996 | Broomall et al. | 174/102 R |

* cited by examiner

*Primary Examiner*—Kristine Kincaid
*Assistant Examiner*—William H. Mayo, III
(74) *Attorney, Agent, or Firm*—Robert F. I. Conte; Lee, Mann, Smith, McWilliams, Sweeney & Ohlson

(57) ABSTRACT

A coaxial cable having a central conductor. A dielectric surrounds the central conductor. A first foil shield surrounds the dielectric and has longitudinal opposite portions overlapping to form a longitudinally extending seam. A second foil shield surrounds the first foil shield and is in conductive contact with the first foil shield. The second foil shield has a thickness greater than or equal to the first foil shield. The second foil shield has longitudinal opposite portions overlapping to form a longitudinally extending seam. A jacket surrounds the second foil shield.

4 Claims, 1 Drawing Sheet

DOUBLE FOIL TAPE COAXIAL CABLE

FIELD OF INVENTION

The present invention concerns a coaxial cable having an inner conductor and an outer conductor. The outer conductor utilizes a braidless design having dual foil tapes.

BACKGROUND OF THE INVENTION

Coaxial cables are well-known. A coaxial cable includes a central conductor. A coaxial cable also includes an outer conductor coaxial to and outside the central conductor. The outer conductor can be a metallic tube conductor or a braid conductor or a foil shield conductor. Generally, a dielectric in the form of spacers or a solid continuous extrusion electronically insulates and separates the central conductor from the outer conductor. The central conductor typically transmits very low voltage current in the form of signals. The signals are typically audio signals, data signals, voice signals, video signals, television signals, or other types of signals.

The outer conductor serves three primary functions. First, it is used to prevent external radiation or noise from affecting the signal transmitted on the central conductor. Second, it prevents signal leakage from the central conductor. Third, the outer conductor, normally at ground potential, acts as a return path for the signal (current) passing through the central conductor.

FIELD OF THE INVENTION

Industry recognizes that braided outer conductors of copper or similar materials provide flexibility and durability. The braided shield to provide effective flexibility needs to have a tiny amount of space between the wires of the braid. To eliminate space, fine wire is braided and/or double braid layers are used. The use of fine wire and double layering, however, may make the shield excessively stiff, large or heavy, and laborious to manufacture.

As an alternative to braided design, industry has used foil shielding. Typically the foil shield is made of a foil tape. A known type of foil tape utilizes aluminum bonded to polyester. The foil tape can include an adhesive so the foil tape can bond to the dielectric surrounding the central conductor. Foil shields eliminate the wire spacing problems associated with braids and generally improve shielding coverage over braided designs. Foil shielding, however, suffers from rupture.

To obtain the shielding benefits of foil tape and the durability of a braid, industry has used a foil tape (foil shield) surrounded by a metallic braid. Unfortunately, the use of a braid increases cost because braiding is slow and labor-intensive. Also, the use of the braid results in a heavier cable with a larger diameter than the cables utilizing only a foil shield.

The present invention improves upon the outer conductor of a coaxial cable. The invention utilizes a first foil shield surrounding the central conductor. The first foil shield is not helically wrapped, but rather is applied longitudinally in a cigarette-wrap configuration. A second foil shield surrounds the first foil shield and is also applied longitudinally in a cigarette wrap. The second foil shield contacts the first foil shield. The second foil shield is in electrical conductive contact with the first foil shield. The outer conductor is thus braidless.

The coaxial cable, by eliminating the braid, improves termination ability. An installer, when hooking the cable to a connector, does not have to comb back the braid over the jacket. Eliminating the braid also improves the integrity of the cable-to-connector interface. The elimination of the braid further reduces cost because the second foil shield is more economical to use than a braid. Elimination of the braid has the further advantage of reducing the diameter of the cable from that of cable utilizing a braid, while providing performance as good as a single-foil/single-braid combination.

DESCRIPTION OF THE RELATED ART

Previous coaxial cables (U.S. Pat. Nos. 5,321,202; 5,521,331; 5,414,213) have utilized a second foil shield. However, in these cables the second foil shield is separated from the first foil shield by an intermediate dielectric. The present invention, by eliminating the intermediate dielectric, reduces the cost of the cable. Also, by eliminating the intermediate dielectric, the present cable maintains electrical performance over a greater range of cable stress. Eliminating the dielectric allows the first and second foil shields to be in electrical contact. Having the first and second foil shields in electrical contact assures continuity in case of rupture.

A previous double-shielded electric cable (U.S. Pat. No. 3,340,353) is also known. In this design, the second shield is applied to solve the problem of cable termination. The cables previous to this known cable's design utilized a foil shield bonded to a polymer jacket. Bonding the foil to the jacket, however, made it difficult to terminate the cable to a connector because peeling back the jacket destroyed the foil bonded to the jacket. The double-shielded cable, by applying a second, thinner foil shield to the first foil shield, allows for easier termination. The peeling back of the jacket destroys only the second, thinner foil shield, leaving the first foil shield undisturbed.

The previous double-shielded cable, however, does not disclose or suggest substituting a second foil shield to maintain an outer conductor's electrical performance over a greater range of cable stress. The thinness of the second shield means that it is not installed to add durability to the outer conductor. The second shield, rather, is applied sacrificially for the purpose of being destroyed during termination. Thus, one would not substitute the second foil shield for a braid.

A communication cable (U.S. Pat. No. 3,636,234) having a first foil shield of copper or aluminum and a second foil shield of tinned annealed steel is also known. The second foil shield is helically wrapped. The use of the tinned annealed steel indicates that the cable is designed to increase the range of noise from which the cable is shielded. Aluminum shields it from high-frequency RF waves and steel shields it from low-frequency magnetic waves.

The cable does not disclose or suggest substituting a second foil shield to maintain the outer conductor's shielding ability over a greater range of cable stress. The steel shielding does not provide continuity in the event of micro-fractures in the aluminum tape because the steel tape shields different frequencies. Alternatively, the aluminum tape does not offer continuity in shielding in the event of micro-fractures in the steel tape because the aluminum tape shields different frequencies. Thus, the aluminum/steel double-shielded design discloses increasing the range of shielding but not maintaining shielding continuity over a greater range of cable stress.

Applicant, however, by utilizing dual aluminum tapes, maintains the outer conductor's shielding ability over a greater range of stress. If the inner shield micro-fractures, the outer shield will offer shielding continuity. If the outer shield micro-fractures, the inner shield will offer shielding continuity. If both shields fracture, the micro-fractures will likely not line up. Thus, the fractured portion of the shield will be covered by a non-fractured portion of the adjacent shield. Therefore the shield will have continuity even if both shields micro-fracture.

Also, by utilizing a second longitudinally-wrapped shield rather than a helically-wrapped shield, applicant improves electrical performance. The longitudinally-wrapped shield prevents the inductance caused by the helically-wrapped shield. By eliminating the inductance, applicant improves the integrity of the signal.

BRIEF SUMMARY OF THE INVENTION

Applicant desires to provide a coaxial cable that maintains shielding ability over a greater range of cable stress than a single shield design but does not suffer from the negative side effects of utilizing a braid, which include slow and laborious braiding, large diameter and heavier cable. It is also desired that the cable have the same electrical performance as a single-foil/single-braid design. Accordingly, applicant provides a coaxial cable composed of a central conductor, a dielectric surrounding the central conductor, and a first foil shield surrounding the dielectric. The first foil shield has longitudinal opposite portions overlapping and forming a longitudinally-extending seam along a longitudinal length of the cable.

A second foil shield surrounds the first foil shield. The second foil shield is in conductive contact with the first foil shield along a longitudinal length of the first foil shield. The second foil shield has a thickness equal to or greater than that of the first foil shield. The second foil shield also has longitudinal opposite portions overlapping and forming a longitudinally-extending seam along the longitudinal length of the cable. The first and second foil shields form an outer conductor of the coaxial cable.

The first and second foil shields can provide means for shielding the central conductor against high-frequency RF waves. The first and second foil shields can be of the same material and both can contain aluminum.

Other novel features of the invention will be further understood with reference to the below detailed description, the drawings and the appended claims.

DETAILED DESCRIPTION OF THE INVENTION

Figure 1:
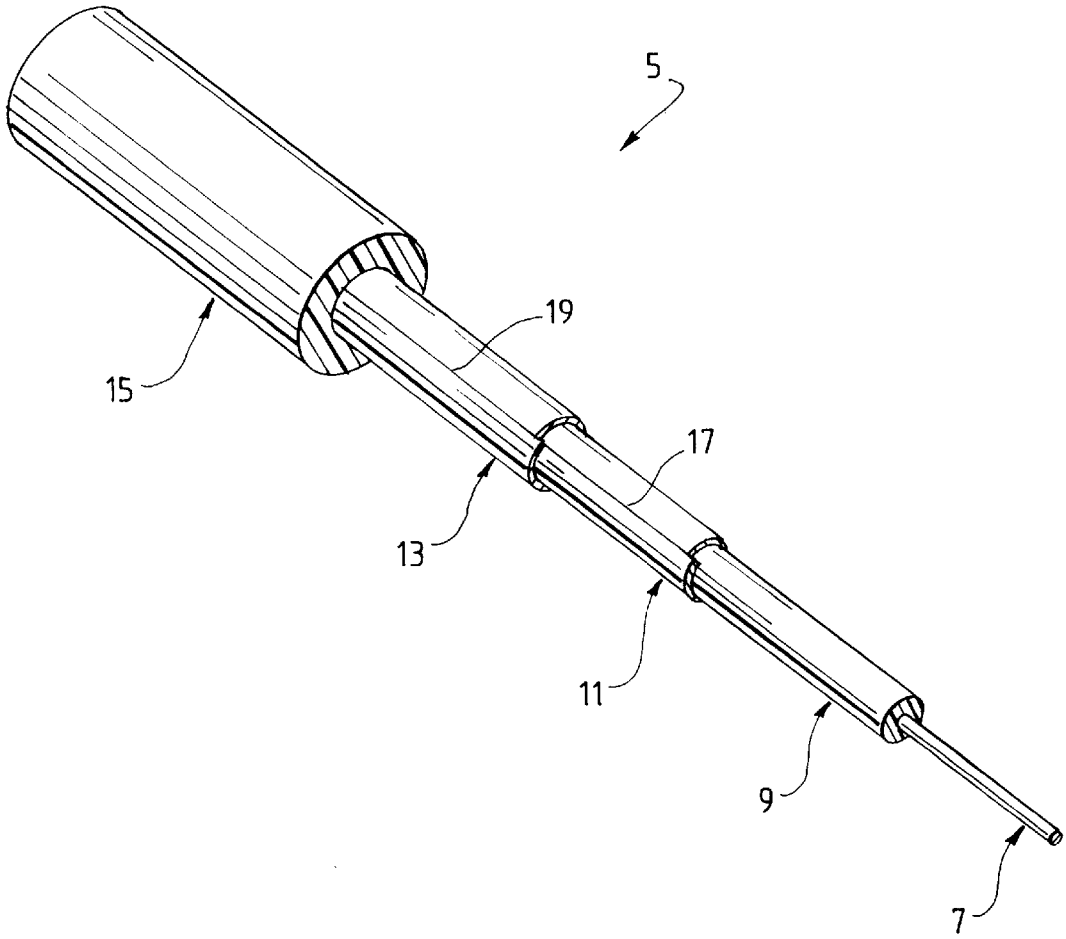
FIG. 1 shows a cutaway top perspective view of the coaxial cable exposing the cable's central conductor, dielectric, first foil shield, second foil shield and outer jacket.

FIG. 1 discloses an example of applicant's coaxial cable. The coaxial cable 5 has a central conductor 7. The central conductor is surrounded by an insulation 9. A first foil shield 11 surrounds and contacts insulation 9. A second foil shield 13 surrounds and contacts the first foil shield 11. The first and second foil shields are in conductive contact and form an outer conductor of the coaxial cable. A jacket 15 surrounds and contacts the second foil shield.

The insulation 9 is applied to the central conductor 7 by known techniques such as extrusion. The insulation completely surrounds the central conductor 7 and contacts the central conductor along the longitudinal length of the central conductor.

The first foil shield 11 is a foil tape and is applied longitudinally and circumferentially around insulation 9. The foil tape 11 is wrapped so that longitudinal opposite portions of the tape overlap to form a first longitudinal seam 17. The seam 17 extends along the longitudinal length of insulation 9. The first foil tape 11 can be described as being applied in a cigarette-wrap configuration. The first foil tape continuously contacts the insulation along the longitudinal length of insulation 9. The first foil tape 11 can be bonded or non-bonded to insulation 9.

The second foil shield 13 is also a foil tape. The second foil tape 13 is applied longitudinally and circumferentially around the first foil tape, in a cigarette-wrap configuration, and forms a longitudinal seam 19. The second foil tape is in continuous physical and conductive contact with the first foil tape along the longitudinal length of the first foil tape. The second foil tape can be bonded or non-bonded to the first foil tape. The second foil tape has a thickness greater than or equal to the thickness of the first foil tape. Both the first and second foil tapes are applied by known forming techniques.

The jacket 15 is then applied to surround the second foil tape. The jacket is applied by conventional techniques such as extrusion.

The construction of the central conductor 7 is standard. The central conductor can be solid bare copper, stranded bare copper, stranded tinned copper or other known constructions. The construction of the insulation 9 is also standard. The insulation can be polyethylene (foam or solid), polypropylene, fluorinated ethylene propylene, tetrafluoroethylene or other known constructions.

The first foil tape 11 and the second foil tape 13 are preferably of the same construction. The first and second foil tapes can be aluminum-polyester-laminate. The tapes can also be aluminum-polyester-aluminum-laminate. The aluminum-polyester-aluminum-laminate tape could have a thickness from about 0.00120 inches to about 0.005 inches. The aluminum-polyester-laminate tape could have a thickness from about 0.00085 inches to about 0.003 inches. The tapes can have adhesive on one or both sides. The tapes do not have to be of the same construction. For instance, one tape can be aluminum-polyester-laminate and the other tape can be aluminum-polyester-aluminum-laminate. The tapes primarily shield the central conductor against high-frequency RF waves.

The jacket is polyvinyl chloride, FEP or other known constructions.

The coaxial cable offers advantages over previous coaxial cables. Utilizing the second foil shield 13 rather than a braid allows the cable to have a smaller diameter while maintaining the electrical performance of other known foil braid designs. Additionally, it allows for eliminating costs associated with slow and laborious braiding.

The cable's design maintains shielding durability over a greater range of cable stresses. Having the shields in electrical contact and having both of the shields operating against high-frequency RF waves means that the outer conductor will maintain continuity, even if both shields micro-fracture as a result of bending. Previous double-shielded designs do not offer this advantage.

Further, by utilizing a longitudinally-applied shield, the cable eliminates induction caused by spiral lays.

The above-described embodiment of the invention is merely an example in which the invention may be carried out. Other ways may also be possible and are within the scope of the claims defining the invention.

What is claimed is:

1. A coaxial cable comprising:

a central conductor;

a dielectric surrounding said central conductor;

a first foil shield surrounding said dielectric, said first foil shield having longitudinal opposite portions overlapping and forming a longitudinally-extending seam along a longitudinal length of said cable;

a second foil shield, said second foil shield surrounding said first foil shield, said second foil shield in conductive contact with said first foil shield along a longitudinal length of said first foil shield, wherein said second foil shield has a thickness equal to or greater than said first foil shield, and wherein said first and second foil shields form an outer conductor of said coaxial cable, and wherein said first and second foil shields both provide means for primarily shielding said central conductor against high-frequency RF waves.

2. The coaxial cable of claim 1 wherein said second foil shield has longitudinal opposite portions overlapping and forming a longitudinally-extending seam along the longitudinal length of said cable.

3. The coaxial cable of claim 2 wherein said first and second foil shields are of the same material.

4. The coaxial cable of claim 3 wherein both said first and second foil shields contain aluminum.

* * * * *